US010101123B2

(12) United States Patent
Wolf et al.

(10) Patent No.: US 10,101,123 B2
(45) **Date of Patent: *Oct. 16, 2018**

(54) PEEP SIGHT WITH INTEGRAL SIGHT POST

(71) Applicants: Floris Bastiaan Wolf, Parker, CO (US); Frederick Wolf, Steamboat Springs, CO (US)

(72) Inventors: Floris Bastiaan Wolf, Parker, CO (US); Frederick Wolf, Steamboat Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/825,027

(22) Filed: Nov. 28, 2017

(65) Prior Publication Data

US 2018/0087874 A1 Mar. 29, 2018

Related U.S. Application Data

(63) Continuation of application No. 15/371,669, filed on Dec. 7, 2016, now Pat. No. 9,829,278, and a continuation-in-part of application No. 14/567,151, filed on Dec. 11, 2014.

(51) Int. Cl.
*F41G 1/467* (2006.01)
*F41B 5/14* (2006.01)

(52) U.S. Cl.
CPC ..... *F41G 1/467* (2013.01); *F41B 5/1419* (2013.01)

(58) Field of Classification Search
CPC ..... F41G 1/467; F41B 5/1419
See application file for complete search history.

(56) References Cited

U.S. PATENT DOCUMENTS

| | | | | |
|---|---|---|---|---|
| 5,347,976 | A | 9/1994 | Saunders | |
| 5,653,217 | A | 8/1997 | Keller | |
| 5,996,569 | A * | 12/1999 | Wilson | F41G 1/467 124/87 |
| 6,170,164 | B1 | 1/2001 | Knowles | |
| 6,560,884 | B1 * | 5/2003 | Afshari | F41G 1/467 124/87 |
| 7,040,027 | B1 | 5/2006 | Shaffer et al. | |
| 2007/0119060 | A1 * | 5/2007 | Grace, Jr. | F41G 1/467 33/265 |
| 2009/0223501 | A1 | 9/2009 | Bach et al. | |
| 2011/0186028 | A1 | 8/2011 | VandeWater | |

* cited by examiner

*Primary Examiner* — Gene Kim
*Assistant Examiner* — Jeffrey Vanderveen
(74) *Attorney, Agent, or Firm* — Alvin R. Wirthlin

(57) ABSTRACT

A peep sight for an archery bow includes a peep sight body with a sight aperture extending therethrough. The sight aperture has an inner surface to create a sight window with a central axis. A rear sight post is located in the sight aperture for alignment with a sight pin or the like of a front sight mounted to the riser of a bow. The rear sight post has a width sufficiently wide to ensure at least a portion of the rear sight post is viewable when in the aiming position in close proximity to the eye yet on the other hand, yet sufficiently narrow to allow ambient light to illuminate the sides of the sight post.

20 Claims, 8 Drawing Sheets

FIG. 3
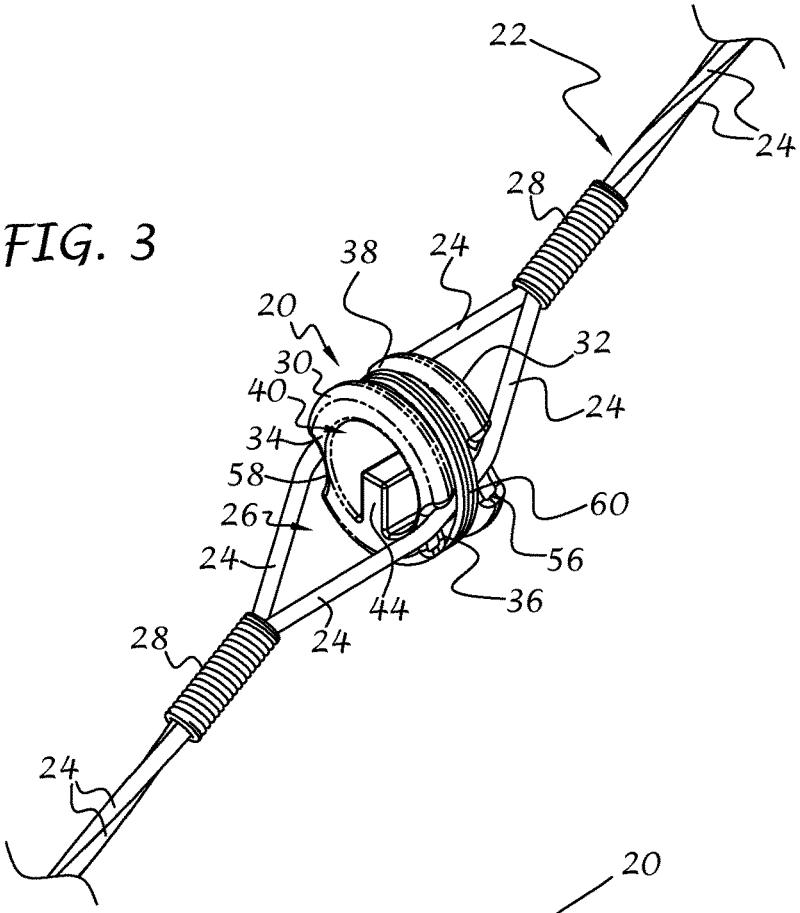
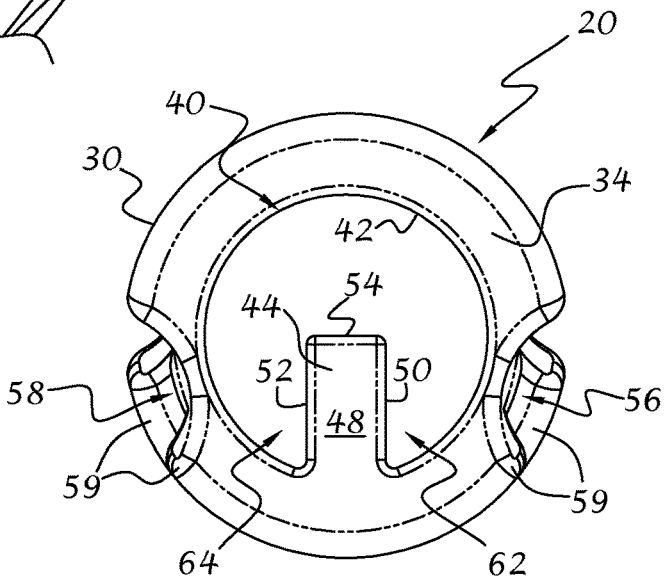
FIG. 4

PEEP SIGHT WITH INTEGRAL SIGHT POST

CROSS-REFERENCE TO RELATED APPLICATIONS

This application is a continuation of U.S. application Ser. No. 15/371,669 filed on Dec. 7, 2016, now U.S. Pat. No. 9,829,278 issued on Nov. 28, 2017, which is a continuation-in-part (CIP) of U.S. application Ser. No. 14/567,151 filed on Dec. 11, 2014 by Floris Bastiaan Wolf and entitled "String Mounted Bow Sight", the disclosures of which are hereby incorporated by reference in their entirety.

BACKGROUND OF THE INVENTION

This invention relates generally to peep sights for archery bows, and more particularly to a peep sight having a rear sight post for more accurately aligning the peep sight with a front sight pin or the like connected to the riser of a bow.

In the field of archery, it is well-known to provide a peep sight on the string above the nocking point of an archery bow. The peep sight works together with the front sight of an archery bow to create two points of reference that form a straight line between the archer's eye and the intended target. This straight line is often referred to as the "line of sight." Ideally, an arrow being shot from the bow will intersect the line of sight at the target location. This requires careful adjustment of the nock point of the arrow on the bowstring as well as the height of the arrow on an arrow rest associated with the riser of a bow, and calibration of the sight pin(s) of the front sight for one or more preset distances between the archer and the target. The peep sight must also be properly located on the bowstring so that a user may accurately sight in the bow sight with respect to a distant target while in a shooting stance, which is often referred to as the "sight picture" or "sight window." The peep sight position is largely dependent on the archer's anchor point when the bow is fully drawn in relation to his or her aiming eye, which may be different for each archer. Since the bow is custom fit to each archer, there are many variables which affect the sight picture, such as the draw length, the size and location of a front sight pin or the like with respect to the archer's eye, the shape of the archer's face including the location of the eye with respect to other prominent facial features that may be used as anchor points during aiming, the size of the peep sight aperture, as well as an archer's eyesight condition.

Referring to FIGS. 1 and 2, a diagrammatic view of a typical archery sighting system is shown. A bow 1 (FIG. 1) has a riser 2 located between an upper limb 2*a* and a lower limb 2*b* with a front sight assembly 3 connected to the riser. The sight assembly 3 has one or more front sight pins 4 connected to the riser 2 via a bracket 3*a*. A bowstring 5 is connected to the bow 1. A peep sight 6 is connected to the bowstring 5 and is adjusted along the bowstring above the nock point 7 of an arrow 8 to form a line of sight 9 between a user's eye 10 adjacent to the peep sight and a distant target 11. As shown in FIG. 2, the peep sight 6 typically includes a body 12 with a sight aperture 13 in line with the user's eye 10 and the sight pin 4. The peep 6 also typically includes side grooves 14 that receive strands (not shown) of the bowstring 5 to mount the peep sight to the bowstring. Such a traditional setting has several drawbacks, since the size of the sight aperture 13 can vary, as well as the distance between the peep sight 6 and the user's eye due to different shooting styles and anchor points, which may be different for each archer. Accordingly, as shown in FIG. 2, it can be difficult to consistently center the front sight pin 4 within the sight aperture, leading to off-center aiming in the horizontal and vertical directions, which ultimately affects the accuracy and consistency of the shot. For example, numerals 4A and 4B represent the front sight pin 4 in phantom line positioned above and below center, respectively. Likewise, numeral 4C represents the front sight pin 4 in phantom line offset from center both vertically above and horizontally to the right, while numeral 4D represents the pin 4 in phantom line offset from center vertically below and horizontally to the left. As shown in FIG. 1, the vertical offset of the front pin 4 with respect to the center of the peep sight 6 results in an incorrect line of sight 9A and an incorrect line of sight 9B extending between the user's eye 10 and the incorrect positions 4A and 4B, respectively, of the front sight pin 4. Accordingly, a small variation in offset at the peep sight, as represented by D1 , can lead to a very large deviation in aiming accuracy at the target, as represented by D2. Although with practice the archer may eventually learn to eyeball the front sight pin more accurately toward center, any small deviation off center can result in a large deviation at the target, thus leading to inaccurate and inconsistent shots, even for more experienced archers.

Accordingly, it would be desirable to provide a peep sight that overcomes at least some of the disadvantages of the prior art.

BRIEF SUMMARY OF THE INVENTION

According to one aspect of the invention, an archery peep sight for mounting to a bowstring of an archery bow, for use in conjunction with a front bow sight attached to the bow for creating a line of sight between a user's eye and a distant target, includes a peep sight body adapted for connection to the bowstring. The body has a front surface, a rear surface, and an outer side surface extending between the front and rear surfaces. A sight aperture extends through the peep sight body between the front surface and the rear surface. The sight aperture has an inner surface to create a sight window with a central axis. A rear sight post is located in the sight aperture. The rear sight post is constructed of material that is impervious to light and has a right side surface and a left side surface extending from the inner surface of the sight aperture, a top surface extending between the right and left side surfaces, and a rear surface extending between the top and right and left side surfaces for view by the eye of a user. The inner surface of the sight aperture together with the right side surface and the left side surface of the rear sight post create right and left gaps, respectively, that are free from obstruction for viewing a distant target. The rear sight post has a width between the right side surface and the left side surface in a range of about 1.5 mm to about 3.5 mm to thereby ensure that at least a portion of the rear surface of the rear sight post is viewable by an eye of a user when in close proximity to the eye during aiming, yet allowing ambient light to enter the right and left gaps to thereby ensure that the sides of the sight post can be seen as well as the distant target through the right and left gaps.

According to a further aspect of the invention, an archery system for consistently shooting an arrow at a point on a target includes an archery bow having a riser, upper and lower limbs extending from opposite sides of the riser, a bowstring extending from the upper and lower risers and forming a nock point for receiving the nock of an arrow, and a front sight assembly connected to the riser. The front sight assembly has at least one front sight pin. The archery system also includes a rear peep sight connected to the bowstring above the nock point and has a peep sight body with a front surface, a rear surface, and an outer side surface extending between the front and rear surfaces, and a sight aperture extending through the peep sight body between the front surface and the rear surface. The sight aperture has an inner surface to create a sight window with a central axis. The peep sight also has a rear sight post located in the sight aperture. The rear sight post is constructed of material that is impervious to light and has a right side surface and a left side surface extending from the inner surface of the sight aperture, a top surface extending between the right and left side surfaces, and a rear surface extending between the right and left side surfaces and the top surface for view by a user. The inner surface of the sight aperture together with the right side surface and the left side surface of the rear sight post create right and left gaps, respectively, that are free from obstruction for viewing a distant target. The rear sight post has a width between the right side surface and left side surface to thereby ensure that at least a portion of the rear sight post is viewable by an eye of a user when in close proximity to the eye during aiming. The rear sight post defines a first point and the at least one front sight pin defines a second point during aiming to thereby create a line of sight between the eye of a user and a distant target.

According to yet a further aspect of the invention, a method of accurately aligning an archery bow sight connected to an archery bow with an intended target for creating a consistent and repeatable line of sight between the eye of an archer and the intended target for accurately hitting the target with an arrow released from the archery bow during shooting, includes providing an archery peep sight on a bowstring of the archery bow, the archery peep sight having a sight aperture for viewing therethrough by a user; providing a sight post in the sight aperture, the sight post being opaque and having a minimum width to ensure it does not disappear from view when in close proximity to the archer's eye during aiming due to focal limitations of the eye; pulling back on the bowstring to an aiming position; viewing the bow sight and the intended target through the sight aperture; and aligning the sight post with the archery sight and the intended target within the sight aperture to thereby form a consistent and repeatable line of sight between the archer's eye and the intended target.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein:

FIG. 3 is an rear right isometric view of a peep sight in accordance with an exemplary embodiment of the invention connected to the bowstring of an archery bow;

FIG. 4 is a rear elevational view of the peep sight in accordance with the invention;

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 6:
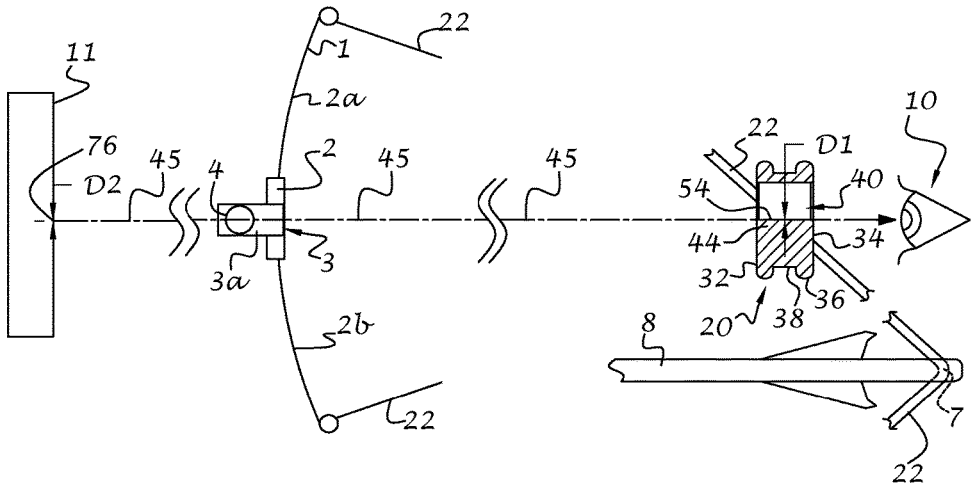
FIG. 6 is a schematic representation of an archer aiming system incorporating the peep sight of the invention, which is shown in section for clarity.
Figure 7:
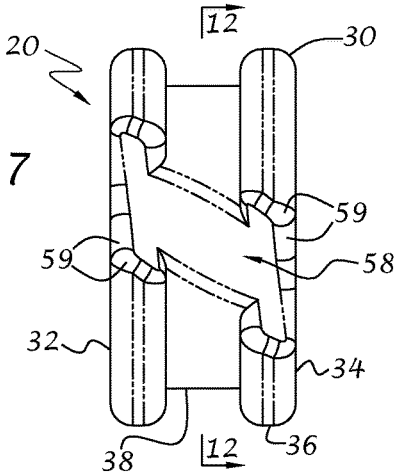
FIG. 7 is a left side elevational view of the peep sight.
Figure 8:
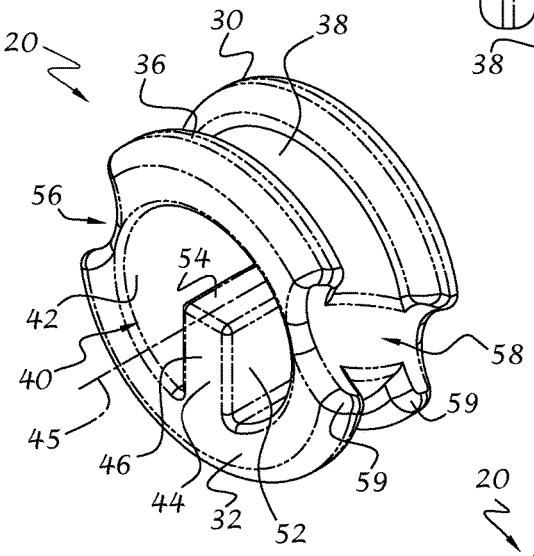
FIG. 8 is a front left isometric view of the peep sight.
Figure 9:
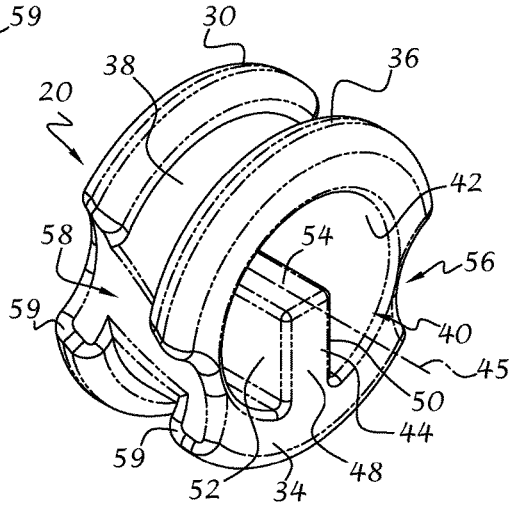
FIG. 9 is a rear left isometric view thereof.
Figure 10:
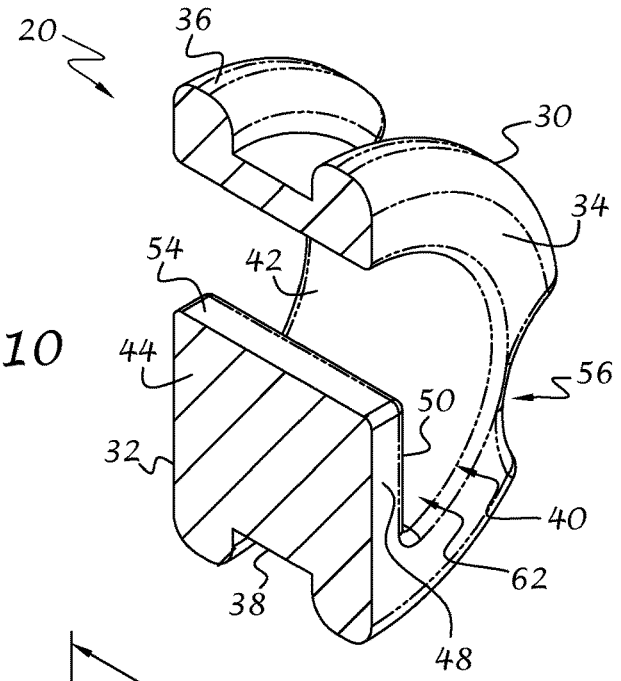
FIG. 10 is an isometric sectional view of the peep sight taken along line 10-10 of FIG. 5.

Referring now to the drawings, and to FIG. 3 in particular, a peep sight 20 in accordance with the present invention is shown connected to a bowstring 22 of an archery bow 1 (shown schematically in FIG. 6). The peep sight 20 can be adapted for use with any type of bow including, but not limited to, recurve bows, reflex bows, longbows, compound bows, and so on. The bowstring 22 is of conventional construction and typically includes multiple strands 24 of any suitable material commonly used to make bowstrings. The peep sight 20 is shown positioned in a gap 26 between the strands 24 when installed on the bowstring 22. The strands are sufficiently flexible, at least when the bowstring is relaxed or non-stressed, to permit the creation of the gap 26 for receiving the peep sight 20. The peep sight 20 is secured between the strands 24 via clamps 28 that encircle the strands 24 in proximity to the sight 20 in a conventional manner. As shown, the clamps 28 can be constructed of elongate cords tied as nail knots around the strands 14 of the string 22. It will be understood that the nail knots may be replaced with other clamps including metallic crimps, rings, or the like.

With additional reference to FIGS. 4, 5, and 7-9, the peep sight 20 preferably includes a generally cylindrically-shaped peep sight body 30 with a front surface 32, a rear surface 34, and an outer continuous circular side surface 36 defining an outer periphery of the body 30 and extending between the front and rear surfaces. An annular channel 38 is formed in the outer side surface 36. A sight aperture 40 extends through the body 30 between the front surface 32 and rear surface 34. The sight aperture 40 is preferably cylindrical and extends coaxially with the sight body 30, but can be offset from the sight body without departing from the spirit and scope of the invention.

Figure 1:
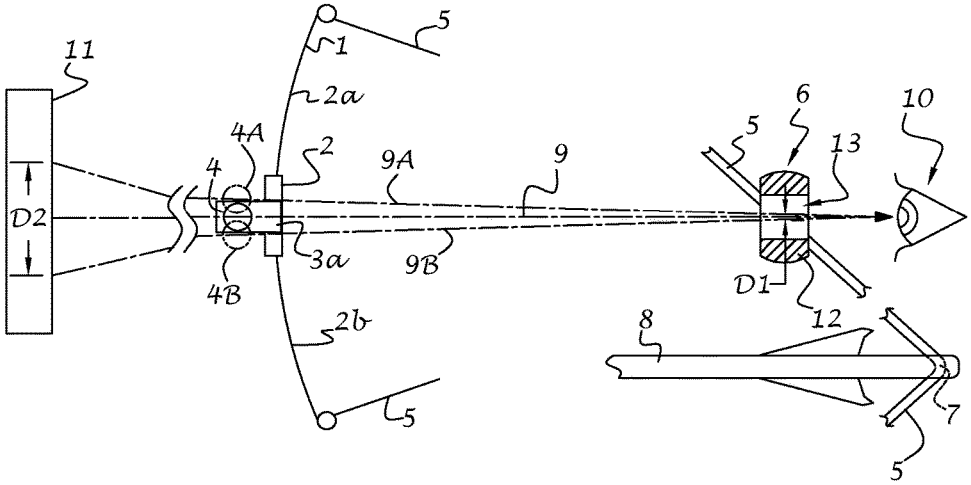
FIG. 1 (Prior Art)
FIG. 1 is a schematic representation of a prior art archery aiming system including a front sight pin and a rear peep sight connected to a bowstring of an archery bow.
Figure 2:
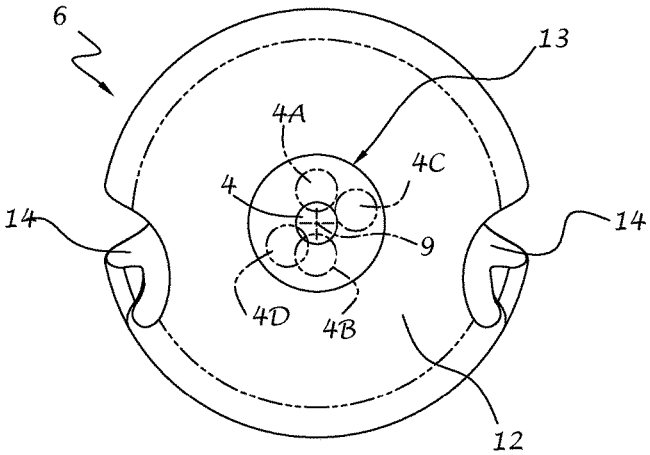
FIG. 2 (Prior Art)
FIG. 2 is a rear view of the prior art peep sight showing varying positions of the front sight pin as viewed through the peep sight aperture by an archer.
Figure 5:
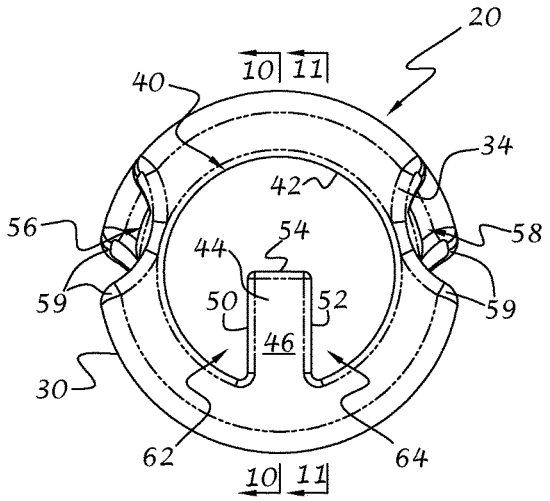
FIG. 5 is a front elevational view thereof.

With the provision of a generally cylindrically-shaped body 30, the sight aperture 40 is defined by an inner generally circular surface 42 to create a circular sight window with a central axis 45 (FIG. 6), which is coincident with the line of sight of an archer in the aiming position, for viewing a front sight pin 4 (FIG. 1) of an archery bow 1 or the like superimposed on a distant target 11 (FIG. 1) when the peep sight 20 is connected to a bowstring. However, it will be understood that the body 30 and sight aperture 40 can be of any suitable shape without departing from the spirit and scope of the invention.

A rear sight post 44 is preferably integrally formed with the sight body 30 and extends upwardly from the inner surface 42 of the sight aperture 40. As shown, the rear sight post 44 has a front surface 46, a rear surface 48, a right-side surface 50 and a left-side surface 52 extending between the front and rear surfaces 46 and 48 respectively, and a top surface 54 extending longitudinally between the front and rear surfaces 46 and 48, respectively, and laterally between the side surfaces 50 and 52. Preferably, the front and rear surfaces 46 and 48, respectively, of the rear sight post 44 are flush with the front and rear surfaces 32 and 34, respectively, of the body 30, such that the length L1 (FIG. 11) of the rear sight post 44 is equal to a length L2 of the body 30, and thus a length of the sight aperture 40. However, it will be understood that the front and/or rear surfaces 46, 48 of the rear sight post 44 can be offset with respect to the front and/or rear surfaces of the body 30 to create a rectangular bar-shaped sight post with a length L1 longer or shorter than the length L2 of the body 30 without departing from the spirit and scope of the invention. Where the front and/or rear surfaces of the peep sight 20 and/or the rear sight post 44 are flat, the front and/or rear surfaces can be coplanar.

In accordance with a further embodiment of the invention, one or more of the front and rear surfaces of the body 30 and the sight post 44 can be curved. Accordingly, the term "flush" can include front and rear surfaces of the body and the sight post that have similar radii while the term "offset" can include surfaces with similar offset radii or different radii and/or surfaces that are spaced from each other in the axial direction. Moreover, it will be understood that the rear sight post 44 is not limited to the rectangular shape as shown, but can be a vertically oriented cylindrical post, an enlarged sphere on top of a smaller vertical post, or any other suitable arrangement for viewing by the archer in close proximity to the archer's eye during aiming. To that end, the sight post 44 also has a width W (FIG. 11) with a critical dimension to enable viewing by the user in close proximity to the user's eye. The post 44 also has a height H (FIG. 11) that facilitates alignment with a front sight pin 4 (FIG. 1) associated with a front bow sight 3 connected to the riser 2 of a bow 1 during aiming, as will be described in greater detail below.

The peep sight 20 is preferably constructed of an opaque, rigid material, such as aluminum or other metal to be both impervious to light and hold its shape and position on the bowstring 22 under relatively large clamping forces when mounted to the bowstring 22 and when subjected to large acceleration forces during shooting. The peep sight 20 can also be constructed of plastic, ceramic, composites, and/or other suitable materials without departing from the spirit and scope of the invention. The peep sight 20 is mounted to the bowstring 22 by the provision of a right side mounting slot 56 and a left side mounting slot 58 formed in the body 30 that receive separated strands 24 of the bowstring 22. The side mounting slots 56 and 58 are located on opposite sides of the body 30. Each slot 56, 58 slants downwardly from the front surface 32 to the rear surface 34 of the peep sight body 30, and intersects opposite sides of the annular groove 38. Preferably, each slot has an outer curved surface 59 or fillet with a radius of about 0.4 mm. This allows the bowstring to 22 to be stretched taut around the peep sight while minimizing or preventing wear or premature failure of the bowstring that may otherwise be caused by sharper slot edges. It will be understood that the radius can vary without departing from the spirit and scope of the invention.

As best shown in FIG. 3, a cord or band 60 wraps around the strands 24 within the confines of the annular groove 38 so that the strands 24 passing through the side mounting slots are firmly secured against the peep sight body to secure the peep sight 20 to the bowstring 22.

The peep sight 20 is preferably dimensioned to accommodate the preferences and/or requirements of different users. It is contemplated that the peep sight can be provided in two or more sizes or a range of sizes, so long as the sight post 44 is provided with proportional dimensions. For example, a larger peep sight can have an approximate thickness of 5 mm (0.197 inch) as measured between the front and rear surfaces, an outer diameter of about 13 mm (0.512 inch) and a sight aperture with an inner diameter of about 8.25 mm (0.325 inch). The sight post would preferably have a width W of about 2.30 mm (0.091 inch). The ratio of sight post width to sight aperture diameter is about 1:3.6. This ratio, although it can vary, ensures that ambient light can enter the peep sight window 40 around the rear sight post 44 to thereby consistently illuminate at least the outer periphery of the rear sight post, and that the rear sight post does not disappear when viewed by the human eye in close proximity. The width of the sight post surprisingly becomes important when viewed in close proximity to the human eye during aiming. If the width of the sight post is inadequate, it can potentially disappear from view, and therefore defeat the purpose of providing a rear sight post in the first place to more accurately form a straight line of sight between the rear peep sight, the front sight pin, and the distant target when compared to prior art peep sights. When the rear sight post disappears from view, the peep sight may not be able to more accurately define the line of sight. The "disappearing" phenomena will be discussed in greater detail below. The sight post 44 also has a height H of about 6.50 mm (0.256 inch) as measured from the outer periphery of the peep sight body 30 to the top surface 54 of the sight post so that the top surface is coincident with the central axis 45 (FIG. 6) of the sight aperture or window 40.

Likewise, a smaller peep sight can have a thickness of about 5 mm (0.197 inch), an outer diameter of about 10.2 mm (0.402 inch) and a sight aperture with an inner diameter of about 6.5 mm (0.256 inch). The sight post would preferably have a width W of about 1.80 mm (0.071 inch). The ratio of sight post width to sight aperture diameter is about 1:3.6, similar to the larger peep sight discussed above. Again, the ratio of sight post width to sight aperture diameter of about 1:3.6 ensures that ambient light can enter the peep sight window 40 around the rear sight post 44 to thereby consistently illuminate at least the outer periphery of the rear sight post. As in the larger peep sight, the width of the sight post in the smaller peep sight is also important as it too may disappear from view during aiming if it is too thin. The sight post 44 also has a height H of about 5.10 mm (0.201 inch) as measured from the outer periphery of the peep sight body 30 to the top surface 54 of the sight post so that the top surface is coincident with the central axis 45 (FIG. 6) of the sight aperture or window 40.

It will be understood that the dimensions of the peep sight 20 can vary without departing from the spirit and scope of the invention, and that the ratio of sight post width to aperture diameter can be within a range of acceptable values.

For example, a preferred range of ratios between the diameter or cross-dimension of the peep sight window or aperture and the width or thickness of the rear sight post is in the range of about 1:1.5 to about 1:5, and more preferably in the range of about 1:3 to about 1:4, and even more preferably in the range of about 1:3.5 to about 1:3.7, with the ratio of 1:3.6 being most preferred. However, it will be understood that these ratios can vary beyond the preferred ratios.

However, a fine balance must be achieved with respect to the width of the sight post. As aforementioned, if the sight post is too thin in width, it may not be discernable by the human eye when in close proximity thereto during aiming. If too wide, the right gap 62 and left gap 64 between the inner surface 42 and the respective right side 50 and left side 52 of the sight post, which are normally open sufficiently for viewing a distant target and ensuring that the sides of the post can be illuminated by ambient light and seen, may be too small to allow sufficient ambient light therethrough. Accordingly, the vertical sides of the sight post may not be adequately illuminated, which may obscure the sight post in this area as well as the distant target.

The lens of the human eye functions similar to the lenses found in telescopes, binoculars, cameras, and so on, by relying on curved lens surfaces to focus light waves. Light enters through the front of the eye, or the cornea, and passes through the lens. The curvatures of both the cornea and lens focus the image on the retina at the rear of the eye. When the eye is focused on an object at a distance, the light enters the eye in parallel wave lines and therefore divergence or convergence of wavelengths at the entry point, or the cornea, does not occur. The parallel wave lines therefore pass through pupil and then through the lens. When the human eye is focused on objects at a distance, the lens is pulled taut by the ciliary ligaments and therefore causes the lens to be less curved. The flatter surface of the lens prohibits the convergence of the parallel light rays on the retina, and therefore the distant image is largely undistorted.

Conversely, when the lens is focused on an object near the eye, there is a much greater degree of divergence to the light rays entering the cornea. This is compensated for by a relaxing of the ciliary ligaments, which allows the lens to become rounder on its front side where light first enters. This rounding of the lens is necessary to bend, or converge, the light in order to compensate for the divergent nature of the light rays entering through the cornea when focused on close objects. This ability to compensate by adjusting the curvature of the lens is limited, however, and is referred to as the accommodative amplitude. As an object becomes increasingly closer to the eye, light rays passing through the cornea become increasingly divergent and the ability of the lens to compensate for the light rays by increasing the curvature via the ciliary ligaments becomes increasingly limited. The lens of the eye can only curve so far. Because of this limitation, a narrow or thin object placed close to the eye cannot be focused and therefore cannot be recognized or even seen by the eye. The thin object thus becomes invisible to the eye to the point where the eye can view a distant object or target right through the thin object.

Figure 14A:
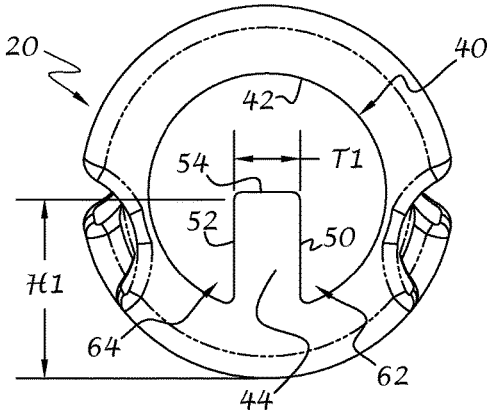
FIGS. 14A to 14C are rear elevational views of the peep sight showing a diminishing view of the peep sight aiming post as the peep sight becomes closer to the archer's eye.
Figure 14B:
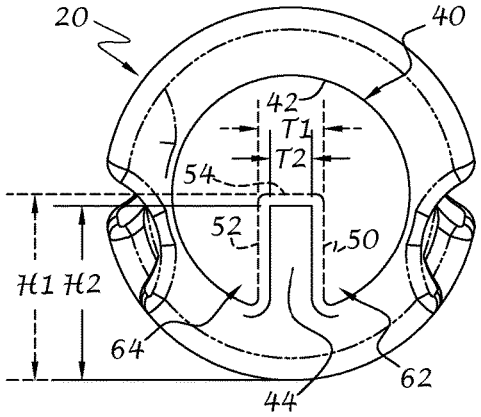
Figure 14C:
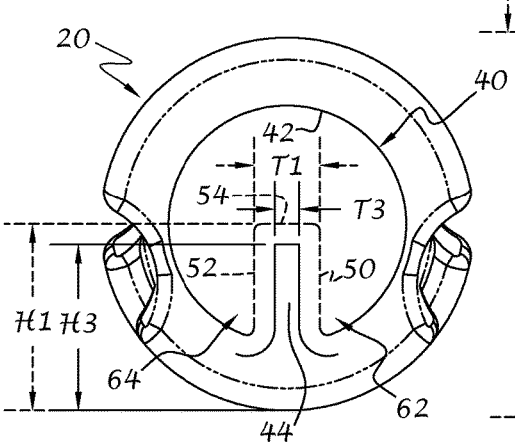

Accordingly, in order to accomplish one of the aspects or purposes of the invention, the width of the rear sight post 44 must be equal to greater than a predetermined minimum dimension. As shown in FIGS. 14A to 14C, the peep sight 20, when viewed at a sufficient distance away from the eye of a user, such as at a distance of about 300 mm (12 inches) or more, has a perceived or viewable width or thickness T1 (FIG. 14A) about equal to the actual width of the rear sight post. Likewise, the sight post has a viewable height H1 about equal to the actual height.

In FIG. 14B, as the peep sight 20 is brought closer to the user's eye, such as at 150 mm (six inches), the apparent or viewable width T2 is less than the actual width T1 (shown in broken line), and the apparent height H2 is less than the actual height H1 (shown in broken line). The area of the sight post 44, within the boundaries of the width T2 and height H2 is substantially in focus, while the area of the sight post between the boundaries T2 and H2 and the original height T1 and width H1 (shown in broken lines), are out of focus and sufficiently transparent to the human eye so that a distant object, target or scene can be viewed in this area.

Likewise, in FIG. 14C, as the peep sight 20 is brought even closer to the user's eye, such as at 100 mm (four inches) or less, when the user has positioned the peep sight in the aiming position while assuming a shooting stance, the apparent or viewable width T3 of the rear sight post is much less than the actual width T1 (shown in broken line), and the apparent height H3 is much less than the actual height H1 (shown in broken line). The area of the sight post 44, within the boundaries of the width T3 and height H3 is substantially in focus, while the area of the sight post between the boundaries T3 and H3 and the actual width T1 and height H1 (shown in broken lines), are out of focus and sufficiently transparent to the human eye so that a distant object, target or scene can be viewed in this area. If the sight post is too thin, the entire post will be out of focus and sufficiently transparent to allow the user to see a distant object, target or scene right through the sight post as if the post wasn't even there, and consequently render the sight post useless for its intended capacity in cooperation with the front sight pin of the bow to create a true or correct line of sight (defined by two points including the front sight pin and the rear sight post) between the user's eye and the target. Without the true line of sight, as discussed above, the front sight pin may not be consistently and properly aligned with the center axis of the rear sight pin, even for experienced archers, and thus variations in aiming, shooting, and hitting the target can occur. Accordingly, establishing the minimum width of the sight post is very important for the proper operation of the present invention.

It is noteworthy that when calibrating the front sight pin(s) and rear sight post for a particular distance between the archer and a target, the front sight pin(s) should be adjusted so that the apparent or viewable top edge or surface 54 of the rear sight post in focus is aligned with the center of the front sight pin to ensure consistency in aiming and shooting, even when the apparent top surface or edge of the rear sight post is below the central axis of the sight window 40. However, it will be understood that the front sight pin or similar component can be aligned with any portion of the rear sight post 44, so long as the alignment is consistent each time the archer assumes the shooting stance with the archery bow drawn to a consistent aiming position.

Figure 14D:
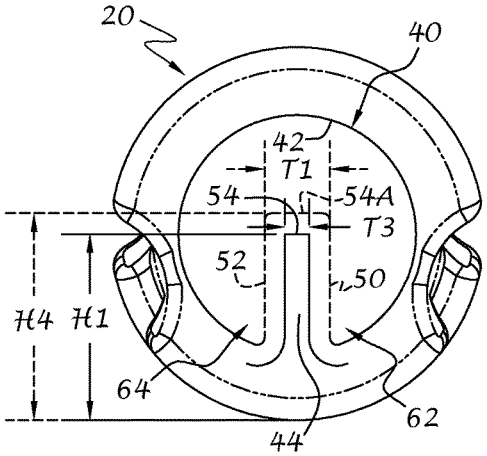
FIG. 14D is a rear elevational view of the peep sight similar to FIG. 14C in accordance with a further embodiment of the invention showing a taller rear sight post.

As shown in FIG. 14D, in order to compensate for the apparent height as viewed by the archer, and in accordance with a further embodiment of the invention, the top surface 54 (shown in broken line) of the rear sight post 44 may be located above the central axis 45 (FIG. 6) of the sight window 40 at a height H4 (shown in broken line) with respect to an outer periphery of the rear peep sight 20, so that the apparent top surface 54A of the rear sight post as viewed by the user is coincident with the central axis 45 of the sight window 40, and is thus equal to the height H1 of FIG. 14A when in the aiming position. In this manner, the rear sight post 44 can be consistently aligned with the front sight pin(s) along the central axis 45 of the sight window 40 for consistent aiming and shooting.

After extensive research with multiple subjects, it was discovered that an average minimum recognizable or focusable width of the peep sight post is about 1.8 mm (0.071 inch) when positioned at about 100 mm (four inches) more or less from the user's eye, which is an approximate average distance between a peep sight in the drawn or aiming position and the user's eye. Below this approximate post width, the rear sight post of the peep sight exceeds the focal capacity of the average human eye and thus cannot be viewed or recognized sufficiently to be useful as a sight point to create a line of sight between the user's eye and the front sight pin and superimposed distant target, as discussed above. Thus, since a line is defined by at least two points, the line of sight cannot be formed on average below the approximate 1.8 mm (0.071 inch) thickness of the sight post at the aiming distance from the user's eye as the point effectively disappears as perceived by the human eye. This is due to the curvature limits of the cornea and lens of the eye.

The present invention thus compensates for the limitations of the human eye by ensuring that the width of the rear sight post is advantageously balanced on one hand to meet the minimum focal requirements of the human eye, while not exceeding a width where the edges or side surfaces of the sight post would be obscured by shadow, especially if the distant scene is brighter, which it typically will be because of the orientation of the peep sight with respect to the user's facial features where light is blocked from impinging on the rear surfaces of the peep sight 20. Accordingly, ambient light cannot adequately fill the spaces or gaps 62 and 64 between the inner surface 42 of the sight window 40 and the side surfaces 50 and 52 of the rear sight post 44 to adequately distinguish the post from the body 30, and may block too much of the front sight pin and superimposed target to be useful.

Accordingly, the rear sight post 44 is preferably within an approximate range of acceptable widths, and is somewhat independent of sight window diameter or cross-dimension, except at the higher end of the range where the gaps may begin to be too small to allow ambient light to define the sides of the post 44. For a sight window 40 having a diameter of about 6.5 mm (0.256 inch) for example, the rear sight post 44 has an approximate width or thickness in the range of about 1.5 mm (.059 inch) to about 3.5 mm (0.138 inch), and more preferably in the range of about 1.75 mm (0.069 inch) to about 1.85 mm (0.071 inch). Ideally, the most preferred minimum width is 1.8 mm (0.071 inch) but due to manufacturing tolerances, dimensional deviations may occur, which are in the purview of the invention. For rear sight posts having sight windows of different diameters, the smallest width of the sight post will not change, but the largest width can change as larger sight windows would allow a wider sight post with sufficiently sized gaps between the side walls of the post to enable illumination by ambient light, and smaller sight windows would require a narrower sight post for the same purpose. However, since it is advantageous to provide the least amount of visual obstruction between the user's eye and the distant target, the sight post in general should be as narrow as practically possible without dropping below the minimum focal requirements of the human eye, as previously discussed.

Figure 11:
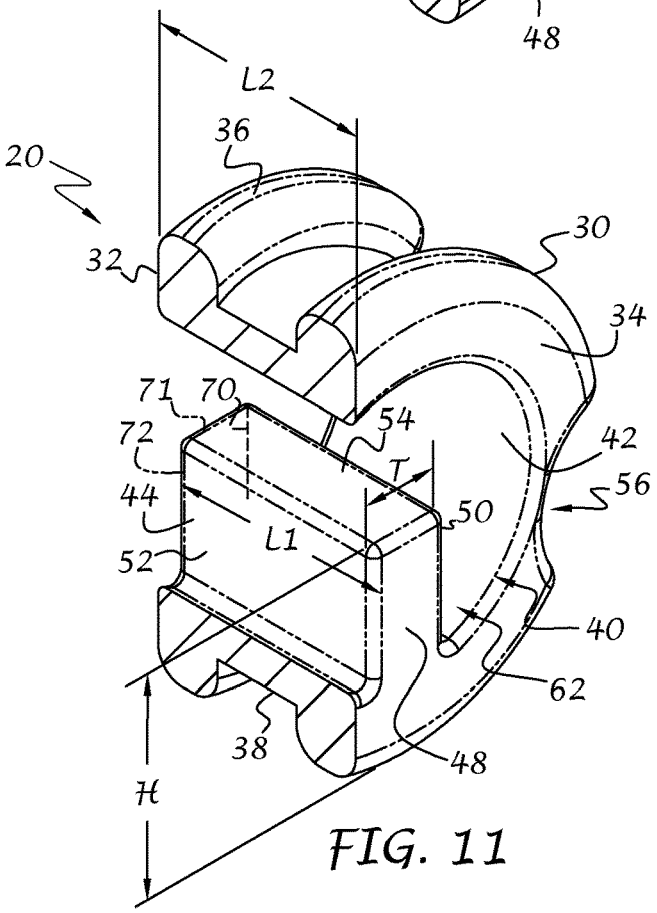
FIG. 11 is an isometric sectional view of the peep sight taken along line 11-11 of FIG. 5.
Figure 12:
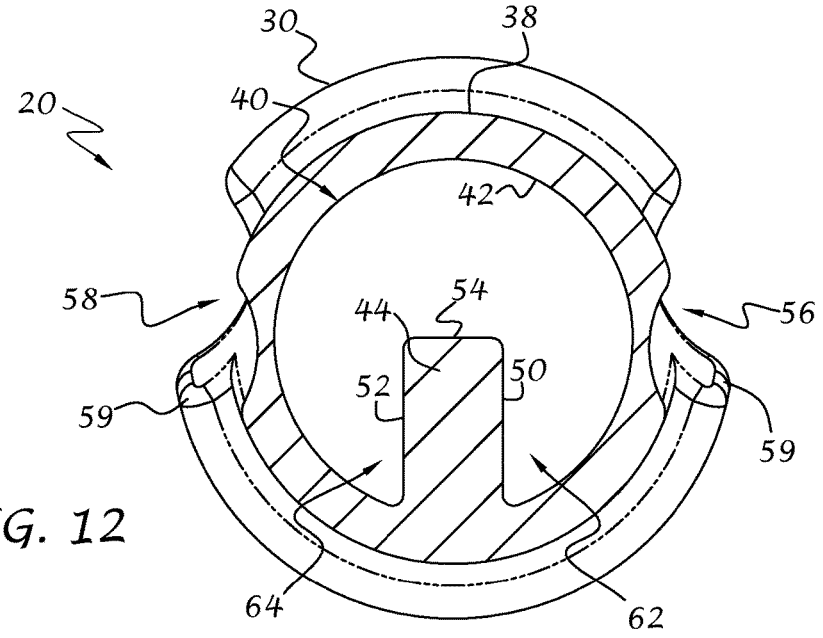
FIG. 12 is a sectional view of the peep sight taken along line 12-12 of FIG. 7.
Figure 13:
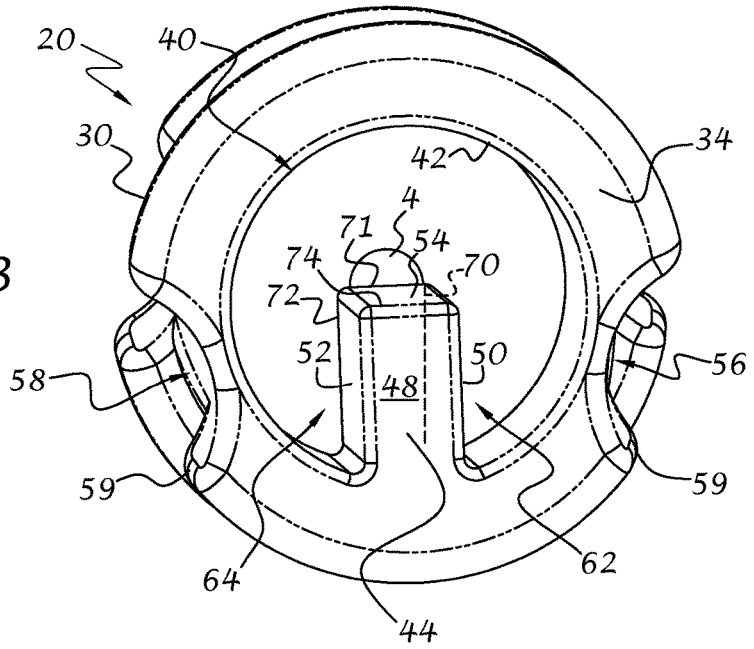
FIG. 13 is a rear view of the peep sight showing incorrect aiming from the archer's point of view.

As best shown in FIGS. 11 and 13, the rear sight post 44 also preferably includes a length L (FIG. 11) that is sufficiently long to determine when the peep sight is improperly mounted on the bowstring or when the archery bow is tilted or canted. Ideally, the user should only see the rear surface 48 of the rear sight post 44 in the aiming position when the peep sight 20 is correctly installed and the archery bow is properly positioned during aiming, such as shown in FIG. 4. When misalignment occurs during aiming however, a front right edge 70 (shown in hidden line in FIG. 7), a front left edge 72, and/or a top front edge 74 will be exposed together with the rear surface 48 of the rear sight post 44. As shown in FIG. 13 for example, the peep sight is not properly aligned with the eye of a user even though the front sight pin 4 (shown in dashed line in FIG. 13) may appear to be perfectly aligned, since the front top edge 74 and front left edge 72 are both exposed for viewing by the user, it will be readily apparent that the peep sight and/or the bow is/are not properly positioned with respect to a user. This feature allows the user to take interventive action prior to shooting the bow to thereby ensure a more accurate and consistent shooting experience. Although the edges of the sight aperture 40 can be used for a similar purpose, the use of the rear sight post in this manner will give the user a better assessment of how far off center the peep sight and/or the bow may be tilted in mutually perpendicular axes, whereas the edges of the sight aperture may not be capable of displaying this information with as much precision.

In accordance with one embodiment of the invention, and by way of example, when the width or thickness of the peep sight 20 from front to rear is about 5 mm (0.197 inch), the rear sight post 44 has a length in the range of about 2 mm (0.079 inch) to about 8 mm (0.315 inch), and more preferably in the range of about 4.5 mm to about 5.5 mm, and most preferably about 5 mm (0.197 inch). However, the aforedescribed dimensions and ranges of dimensions are given by way of example only. It will therefore be understood that the rear sight post can be of any suitable length without departing from the spirit and scope of the invention.

In use, and with particular reference to FIG. 6, a bow 1 has a riser 2 with a front sight 3 connected thereto. The sight 3 has one or more front sight pins 4 connected to the riser 2. A bowstring 22 is connected to the bow 1. A peep sight 20 is connected to the bowstring 22 and is adjusted along the bowstring above the nock point 7 of an arrow 8. The rear sight post 44 within the sight window 40 serves as a first point on a line of sight 45 and the front sight pin 4 serves as a second point on the line of sight between a user's eye 10 adjacent to the peep sight 20 and a distant target 11. The rear sight post 44 ensures that the front sight pin 4 or any known front sighting structure or devices is always axially centered with the sight window 40 to thereby create a consistent line of sight 45 between the eye 10 and the target 11 so that the arrow 8 can be consistently aimed at the desired point 76 on the target 11. In contrast to the prior art, the provision of the rear sight post 44 ensures that the front sight pin 4 or the like is consistently centered in the sight aperture 40 so that the distance D1, which represents site line deviation within the sight aperture, is at zero, and distance D2, which represents site line deviation (and thus arrow positioning) on the target 11, because of the deviation represented by D1, is also at zero. Accordingly, when the archery bow, the front sight 3 and sight pin 4, and the rear peep sight including the sight post 44 are properly aligned and calibrated, and the archer is consistent with his or her aiming stance, there will always be the potential of zero deviation in the line of sight 45, thereby ensuring that the arrow will potentially always hit the intended point 76 on the target 11. In this manner, uncertainty or inaccuracy in consistently hitting the same spot on the target due to the variations in estimating where the axial center of the sight aperture may be and whether or not the front sight pin is centered in the sight aperture, is substantially, if not completely, removed.

Accordingly, the drawbacks of the prior art, where the front sight pin may not be exactly on center with the rear peep sight window due to archer error, excitement due to the acquisition of a desired target, or simply misjudging the relative positions between the front sight pin and the axial center of the rear peep sight window, are overcome by the provision of a rear peep sight with integral rear sight post of the present invention.

Figure 15:
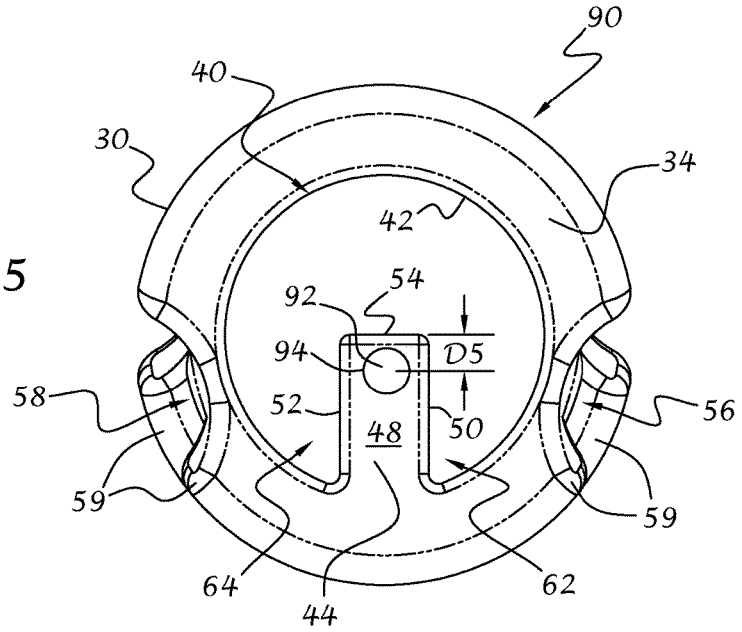
FIG. 15 is a rear elevational view of a peep sight in accordance with a further embodiment of the invention.

Referring now to FIG. 15, a peep sight 90 in accordance with a further embodiment of the invention is illustrated. The peep sight 90 is similar in construction to the peep sight 20 previously described, with like numerals representing like elements or features. The peep sight 90 additionally includes an illuminated rear sight dot in the form of an artificial luminescent light source 92 that is located on a surface 94 formed in the rear sight post 44 near the top surface 54 thereof and centered on the rear surface 48 between the right side surface 50 and left side surface 52. The surface 94 is preferably a depression or dimple but may be a projection or a bore depending on the type of artificial light source used. In any event, the center of the surface 94, and thus the artificial light source, is spaced a predetermined distance D5 from the top surface 54 so that the top of the rear sight post 44 is out of focus and thus relatively transparent to the eye of a user when the peep sight 90 is positioned close to the eye in an aiming position. In this manner, the front sight pin 4 (FIG. 6) can be viewed by the user while aligning the light source 92 on center with the front sight pin 4.

The artificial luminescent light source preferably comprises a phosphorescent coating such as zinc sulfide or strontium aluminate mixed with ink, paint, or other liquid that can be applied to the surface 94 with a reasonable degree of durability. Such substances are known as phosphorescent paint or glow-in-the-dark paint that preferably can be charged by sunlight or artificial light and have a sustained glow which lasts for several hours after exposure to light.

In accordance with a further embodiment of the invention, the luminescent light source can comprise a self-luminous device, such as a sealed vial or tube filled with tritium gas or other radioluminescence materials. Where a tritium vial is used, the surface 94 can be in the form of an opening, depression, dimple, or bore depending on the particular shape of the vial. Tritium for example is a radioactive isotope of hydrogen that emits electrons through beta decay. When tritium gas is contained inside a transparent tube or vial coated on the inside with a phosphor material, the electrons emitted via beta decay of the tritium gas interact with the phosphor coating to produce fluorescent light. The tritium light source typically has a useful life between about 10 to 20 years without the need for outside power, and is sufficiently low in brightness so that the user's eye will not be overwhelmed, especially due to the close proximity of the light source in the aiming position, even in low light conditions such as at dusk or dawn. In this manner, the user will be able to easily spot the front sight pin and align it with the light source 92 for consistent aiming at a distant target.

Figure 16:
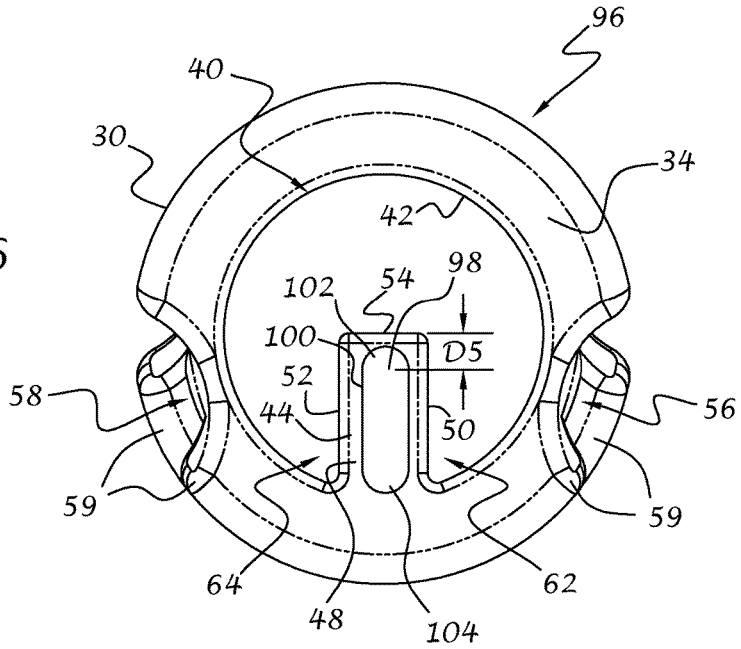
FIG. 16 is a rear elevational view of a peep sight in accordance with yet another embodiment of the invention.

Referring now to FIG. 16, a peep sight 96 in accordance with another embodiment of the invention is illustrated. The peep sight 96 is similar in construction to the peep sight 90 previously described, with like numerals representing like elements or features, and includes the provision of an elongate artificial light source 98 that is coated on or mounted within an elongate surface 100 formed in the rear surface 48 of the rear sight post 44. The surface 100 can be in the form of a depression, dimple, projection, elongate groove or bore, as described in the previous embodiment, depending on the particular artificial light source used. In any event, the surface 100 has an upper portion 102 that commences near the top surface 54 of the sight post 44 and is spaced a predetermined distance D5 from the top surface 54 so that the top of the rear sight post 44 is out of focus and thus relatively transparent to the eye of a user when the peep sight 96 is positioned close to the eye in an aiming position. In this manner, the front sight pin 4 (FIG. 6) can be viewed by the user while aligning the elongate light source 98 on center with the front sight pin 4. The surface 100 also has a lower portion 104 that terminates near the bottom of the sight post 44, which is almost coincident with the inner surface 42 of the sight window or aperture 40.

The artificial light source 98 preferably comprises a phosphorescent coating or glow-in-the-dark ink or paint as described above. In accordance with a further embodiment of the invention, the artificial light source can comprise an elongate self-luminous tritium vial or tube or other radioluminescence light source that is positioned vertically. The vertical positioning and the relative width and length of the artificial light source 98, whether it be a phosphorescent coating or a radioluminescent light source, ensures that substantially the entire focusable length of the rear sight post 44 will be viewable by the user when in close proximity to the user's eye during aiming. In this manner, the artificial light source can be helpful in not only aligning the front sight pin with the rear sight post as previously described, but also ensuring that the rear sight post, and thus the rear peep sight 96, is properly aligned with respect to the front sight pin(s) and the distant target, as more of the rear sight post is illuminated than in the previous embodiment. This is especially important when shooting in low light conditions, such as at dusk or dawn.

It will be understood that the above embodiments with the artificial light source are not limited to phosphorescence or radioluminescence, but may comprise other self-illuminating light sources.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, although the peep sight body and the sight window or aperture have been shown as circular in shape, it will be understood that such features can be of any suitable shape without departing from the spirit and scope of the invention. Moreover, it will be understood that the rear sight post can be of other suitable shapes as long as the minimum width requirements are met to accommodate the minimum focal distance of an average user's eye. Furthermore, it will be understood that the rear sight post need not extend in a vertical direction only, but may extend from the inner side surface toward the central axis of the sight window at any orientation or angle with respect to vertical. For example, the rear sight post can be oriented horizontally (90 degrees from vertical), or 45 degrees from vertical, 60 degrees, 120 degrees, 135 degrees, or any other orientation. It will be understood, therefore, that the present invention is not limited to the particular embodiments disclosed, but also covers modifications within the spirit and scope of the invention as defined by the appended claims.

What is claimed is:

1. An archery peep sight for mounting to a bowstring of an archery bow, for use in conjunction with a front bow sight attached to the bow for creating a line of sight between a user's eye and a distant target, the peep sight comprising:

a peep sight body adapted for connection to the bowstring:

a sight aperture extending through the peep sight body, the sight aperture having an inner surface to create a sight window with a central axis; and a rear sight post located in the sight aperture, the rear sight post being constructed of material that is impervious to light and having a right side surface and a left side surface extending into the sight aperture for view by the eye of a user;

the inner surface of the sight aperture together with the right side surface and the left side surface of the rear sight post creating right and left gaps, respectively, through which a distant target can be viewed;

the rear sight post having at least a minimum width between the right side surface and the left side surface to thereby ensure that a portion of the rear sight post is viewable by the eye of a user when in close proximity to the eye during aiming due to focal limitations of the eye that cause a periphery of the rear sight post to appear transparent, yet allowing ambient light to enter the right and left gaps to thereby ensure that the sides of the rear sight post can be seen.

2. An archery peep sight according to claim 1, wherein the width of the rear sight post is in the range of about 1.5 mm to about 3.5 mm to thereby ensure that a portion of the rear sight post can be seen as well as the distant target through the right and left gaps.

3. An archery peep sight according to claim 1, wherein the minimum width of the rear sight post is about 1.8 mm to ensure a portion of the rear sight post can be seen when viewed in close proximity to the user's eye during aiming to thereby ensure that a portion of the rear sight post can be seen as well as the distant target through the right and left gaps.

4. An archery peep sight according to claim 2, wherein the inner surface of the sight aperture is circular and has an inner diameter that defines a size of the sight window.

5. An archery peep sight according to claim 4, wherein a ratio of the width of the rear sight post to the inner diameter of the sight window is in a range of about 1:1.5 to about 1:5 to ensure that at least a portion of the rear sight post is viewable by an eye of a user when in close proximity to the eye during aiming, yet allowing ambient light to enter the right and left gaps to thereby ensure that the sides of the sight post can be viewed by the user, as well as the distant target through the right and left gaps.

6. An archery peep sight according to claim 4, wherein a ratio of the width of the rear sight post to the inner diameter of the sight window is in a range of about 1:3 to about 1:4 to ensure that a portion of the rear sight post is viewable by an eye of a user when in close proximity to the eye during aiming, yet allowing ambient light to enter the right and left gaps to thereby ensure that the sides of the sight post can be viewed by the user, as well as the distant target through the right and left gaps.

7. An archery peep sight according to claim 4, wherein a ratio of the width of the rear sight post to the inner diameter of the sight window is about 1:3.6 to ensure that a portion of the rear sight post is viewable by an eye of a user when in close proximity to the eye during aiming, yet allowing ambient light to enter the right and left gaps to thereby ensure that the sides of the sight post can be viewed by the user, as well as the distant target through the right and left gaps.

8. An archery peep sight according to claim 1, and further comprising:

an annular channel formed in an outer side surface of the peep sight body, the outer side surface being located between front and rear surfaces of the peep sight body; and right and left side mounting slots formed in the peep sight body on opposite sides thereof, each side mounting slot slanting downwardly from the front surface to the rear surface of the peep sight body and intersecting with the annular channel;

wherein the side mounting slots are adapted to receive separate strands of a multi-stranded bowstring and the annular channel is adapted to receive a cord that wraps around the strands passing through the side mounting slots to thereby firmly secure the peep sight to the bowstring.

9. An archery peep sight according to claim 8, wherein each side mounting slot has an outer curved surface or fillet with a radius of about 0.4 mm to minimize or prevent wear or premature failure of the bowstring when stretched taut through the side mounting slots.

10. An archery peep sight according to claim 1, wherein the rear sight post further comprises a top surface extending between the right and left side surfaces of the rear sight post, the top surface being coincident with the central axis of the sight window.

11. An archery peep sight according to claim 1, wherein the rear sight post is of sufficient length along a direction of the central axis so that at least one forward edge of the rear sight post is exposed when misalignment between the user's eye and the peep sight occurs.

12. An archery peep sight according to claim 1, wherein the rear sight post further comprises a top surface extending between the right and left side surfaces of the rear sight post, the top surface being located above the central axis so that a perceived upper surface of the rear sight post is coincident with the central axis during aiming due to the actual upper surface being perceived as transparent when the peep sight is close to the eye of a user during aiming.

13. An archery peep sight according to claim 1, and further comprising an illuminated rear sight dot connected to the rear sight post between the right side surface and left side surface and spaced a predetermined distance from a top surface thereof, with an upper portion of the rear sight post being out of focus and thus transparent to the eye of a user due to focal limitations of the eye when the peep sight is positioned close to the eye in an aiming position, such that a front sight pin is viewable by the user through the upper transparent portion to align the light source with the front sight pin.

14. An archery peep sight according to claim 13, wherein the light source is elongate and extends along a substantial height and width of the rear sight post to thereby illuminate a substantial area of a rear surface of the rear sight post located between the right and left side surfaces for view by a user under low ambient light conditions to thereby align the rear sight post with respect to a front sight pin and a distant target.

15. An archery system for consistently shooting an arrow at a point on a target, the system comprising:

an archery bow having a riser, upper and lower limbs extending from opposite sides of the riser, a bowstring extending from the upper and lower risers and forming a nock point for receiving the nock of an arrow, and a front sight assembly connected to the riser, the front sight assembly having at least one front sight pin;

a rear peep sight connected to the bowstring above the nock point, the rear peep sight comprising:

a peep sight body;

a sight aperture extending through the peep sight body, the sight aperture having an inner surface defining a central axis; and a rear sight post located in the sight aperture, the rear sight post being constructed of an opaque material and having a right side surface and a left side surface extending into the sight aperture for view by a user;

the inner surface of the sight aperture together with the right side surface and the left side surface of the rear sight post creating right and left gaps, respectively, for receiving ambient light to thereby distinguish between the left and right side surfaces and the inner surface of the sight aperture;

the rear sight post having a width between the right side surface and left side surface to thereby ensure that a portion of the rear sight post is viewable by an eye of a user when in close proximity to the eye during aiming due to focal limitations of the eye that cause a periphery of the rear sight post to appear transparent; and the rear sight post defining a first point and the at least one front sight pin defining a second point during aiming to thereby create a line of sight between the eye of a user and a distant target.

16. An archery system according to claim 15, wherein the rear sight post further comprises a top surface extending between the left and right side surfaces, with one of the actual top surface and a perceived top surface of the rear sight post due to focal limitations of the eye is coincident with the central axis and the at least one front sight pin.

17. An archery system according to claim 15, wherein a width of the rear sight post is in the range of about 1.75 mm to about 2.35 mm when the sight window has a diameter in the range of about 6.25 mm to about 8.5 mm to thereby ensure that at least a portion of the rear sight post is viewable by the eye of a user when in close proximity to the eye during aiming, yet allowing ambient light to enter the right and left gaps to thereby ensure that the sides of the sight post can be seen as well as the distant target through the right and left gaps.

18. An archery system according to claim 15, wherein a minimum width of the rear sight post is about 1.8 mm to ensure at least a portion of the rear sight post can be seen when viewed in close proximity to the user's eye during aiming to thereby ensure that at least a portion of the rear sight post is viewable by the eye of a user when in close proximity to the eye during aiming, yet allowing ambient light to enter the right and left gaps to thereby ensure that the sides of the sight post can be seen as well as the distant target through the right and left gaps.

19. An archery system according to claim 15, and further comprising an illuminated rear sight dot having a radioluminescence light source positioned on the rear sight post at a location between the right side surface and left side surface and spaced a predetermined distance from a top surface of the rear sight post, with an upper portion of the rear sight post being out of focus and thus perceived as relatively transparent to the eye of a user when the peep sight is positioned close to the eye in an aiming position, such that the front sight pin is viewable by the user through the upper perceived relatively transparent portion to align the light source with the front sight pin.

20. A method of accurately aligning a front archery bow sight connected to the riser of an archery bow with an intended target for creating a consistent and repeatable line of sight between the eye of an archer and the intended target for accurately hitting the target with an arrow released from the archery bow during shooting, the method comprising;

providing a rear peep sight on a bowstring of the archery bow, the rear peep sight having a sight aperture for viewing the front archery bow sight and the intended target therethrough by a user;

providing a rear sight post in the sight aperture, the rear sight post being opaque for normally blocking a view of the front archery bow sight and the intended target, the rear sight post having a minimum width to ensure it does not disappear from view when in close proximity to the archer's eye during aiming due to focal limitations of the eye;

pulling back on the bowstring to an aiming position;

viewing the bow sight and the intended target through the sight aperture and a perceived transparent portion of the rear sight post as viewed in the aiming position; and aligning the rear sight post with the archery sight and the intended target within the sight aperture to thereby form a consistent and repeatable line of sight between the archer's eye and the intended target.

* * * * *